US005860237A

United States Patent [19]

Johnson

[11] Patent Number: 5,860,237

[45] Date of Patent: Jan. 19, 1999

[54] SLEEVE SIGN AND STAND

[76] Inventor: David E. Johnson, 606 Lumpkin Campground Rd., Dawsonville, Ga. 30534

[21] Appl. No.: 720,526

[22] Filed: Sep. 30, 1996

[51] Int. Cl.[6] ..... G09F 15/00

[52] U.S. Cl. ..... 40/603; 40/606

[58] Field of Search ..... 40/524, 5, 603, 40/604, 606, 607, 611, 612

[56] References Cited

U.S. PATENT DOCUMENTS

| | | | |
|---|---|---|---|
| 488,411 | 12/1892 | Wyman | 40/524 X |
| 2,127,930 | 8/1938 | Osborn | 40/603 |
| 3,787,993 | 1/1974 | Lyon | 40/5 X |
| 4,516,620 | 5/1985 | Mulhern | 40/606 X |
| 4,817,319 | 4/1989 | Vitale | 40/610 |
| 4,875,302 | 10/1989 | Noffsinger | 40/610 |
| 5,199,375 | 4/1993 | Johnson | 116/209 |
| 5,388,794 | 2/1995 | Wolff | 40/607 X |
| 5,488,792 | 2/1996 | Kwok | 40/612 |

*Primary Examiner*—Brian K. Green
*Attorney, Agent, or Firm*—Kenneth S. Watkins, Jr.

[57] ABSTRACT

A sign for highway use or advertising comprises a sign stand 100 and a replaceable stretch sleeve 401. The sign stand comprises a base 120 and two vertical columns 106, 107 having receiving surfaces 106D, 108D comprising recesses 106F, 108F and raised portions 106E, 108E. The sleeve is stretched over the vertical surfaces and is retained in the recesses of the vertical surfaces by the raised portions. The sleeve is made of polyethylene film and contains indicia 407. The stretchable sleeve provides a means to easily replace the indicia of the signs. The sleeve is reusable and recyclable.

7 Claims, 7 Drawing Sheets

SLEEVE SIGN AND STAND

BACKGROUND OF THE INVENTION

The present invention relates to signs and, more particularly, to signs with replaceable indicia.

There are numerous uses for signs including advertising, directing traffic and warning of hazards. The need for signs in road and building construction has increased dramatically due to increased development, maintenance of ever expanding highway systems, and increased awareness of liability issues. Highway markers such as the familiar fluorescent plastic cones have provided a simple and effective marker. Another example of a highway warning marker is disclosed in U.S. Pat. No. 5,199,375. The marker has a pyramidal shape and a brightly colored and reflective fabric cover. U.S. Pat. No. 5,488,792 discloses a collapsible cone shaped marker having a conical spring frame. However, these markers lack the flexibility to be used in many applications where specific information must be conveyed to the public.

Display signs with indicia convey additional information to drivers and pedestrians. For example, U.S. Pat. No. 4,817,319 discloses a collapsible sign. The sign utilizes a frame comprising two vertical legs and a cross member. A rectangular web comprises casings along three edges of the web. The casings enclose the framing members. Tubular connectors are used to engage the ends of the frame members. Indicia may be placed on the front and back of the web. The frame must be disassembled and the web changed to change indicia.

U.S. Pat. No. 4,875,302 discloses a collapsible display sign having a frame which has a folded and extended mode. A stretchable elastic fabric is used to secure the frame members in an open position. Sign boards may be mounted on the fabric. The web must have high strength since it provides the biasing means to maintain the frame in the open position. Changing the fabric requires disassembly of the frame. If separate sign boards are used for indicia, two boards are required for viewing from opposite directions.

A need exists for a display sign which overcomes the disadvantages of currently used signs.

SUMMARY OF THE INVENTION

Therefore an object of the present invention is to provide a sign in which the indicia may be easily changed.

A further object of the present invention is to provide a sign which has flexibility in the size and number of indicia displayed.

A further object of the present invention is to provide a sign which is highly visible in two opposite directions and is resistant to wind and mechanical disturbances.

A further object of the present invention is to provide a sign which is simple to assemble.

Yet another object of the present invention is to provide a sign having an indicia carrying web which is economical, disposable, and recyclable.

The sign comprises a sign stand and stretchable sleeve. The sign stand comprises a generally rectangular frame comprising a top, bottom and at least two receiving surfaces each having at least one raised portion and one recessed portion. The sleeve is stretched over the sign stand and relaxed onto the receiving surfaces. The raised portion of each receiving surface engages the sleeve to retain the sleeve in the desired position.

In one embodiment, a plurality of raised portions and recessed portions are employed in the receiving surfaces.

The sleeve in the recessed portions must stretch in excess of its installed stretch in order for the sleeve to move up or down. The sign stand may comprise a base attached to the bottom of the frame.

In the preferred embodiment the receiving surfaces are formed by the outside surfaces of two vertical columns. The vertical columns are joined by a top cross member or beam and a bottom beam to form a generally rectangular frame. The frame may be attached to a base to form a sign stand. A stretchable plastic film sleeve, open at the top and bottom is stretched over the top of the frame and the sleeve positioned on the receiving surfaces. The outside surfaces of the columns comprise a plurality of recessed portions and raised portions. The sleeve is retained in the recessed portions. The raised portions engage the sleeve to prevent undesired movement. The plurality of raised portions may form a series of steps, smooth waves, or sharp ridges in the outer receiving surfaces.

BRIEF DESCRIPTION OF THE DRAWINGS

These and other features, aspects and advantages of the present invention will become better understood with regard to the following description, appended claims and accompanying drawings where:

DESCRIPTION OF THE PREFERRED EMBODIMENTS

The following is a description of the preferred embodiments of a sleeve sign stand and stretchable sign sleeve for providing a low cost, durable sign in which the indicia may be easily changed.

Figure 1:
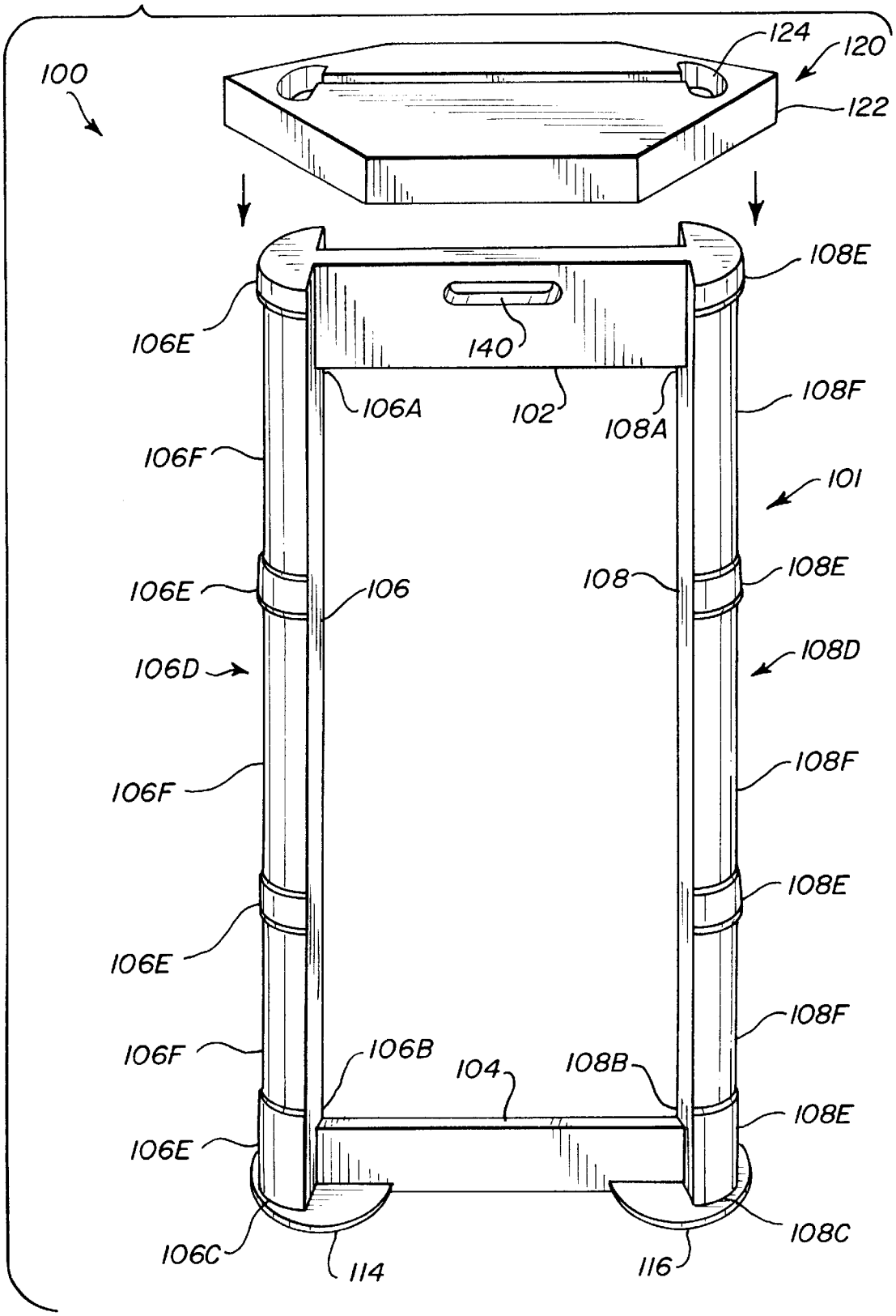
FIG. 1 is a perspective drawing of the sign stand with frame and a base in position to be installed over the frame.

FIG. 1 shows embodiment 100 of a sign stand for sleeve signs. The stand comprises a generally rectangular frame 101 and base 120. Frame 101 comprises a top beam 102, a bottom beam 104, a first vertical column 106 and a second vertical column 108. Top beam 102 is fixed to a top portion 106A of first column 106 and a top portion 108A of second column 108. Bottom beam 104 is fixed to a bottom portion 106B of first column 106 and a bottom portion 108B of second column 108. First flange 114 is fixed to bottom end 106C of first column 106 and second flange 116 is fixed to bottom end 108C of second column 108.

First column 106 comprises a first outside edge surface 106D. Second column 108 comprises a second outside edge surface 108D. Surface 106D and surface 108D may be curved surfaces as shown in FIG. 1 or, alternatively, they may be flat or sharp edged surfaces. Surface 106D and surface 108D are separated by top beam 102 and bottom beam 104 and form the receiving surfaces over which a stretch sleeve is placed as shown and described in FIGS. 4 and 5. Surface 106D comprises a plurality of ridges or raised portions 106E and recesses 106F. Surface 108D comprises a plurality of ridges or raised portions 108E and recesses 108F.

Base 120 comprises a hexagonal disk 122 made of a durable material of sufficient density to provide stability of the sign stand. A through aperture 124 allows base 120 to be inserted over the top portion of frame 101 as shown by the arrows of FIG. 1. Aperture 140 provides a convenient handle for carrying sign stand 100.

Figure 2:
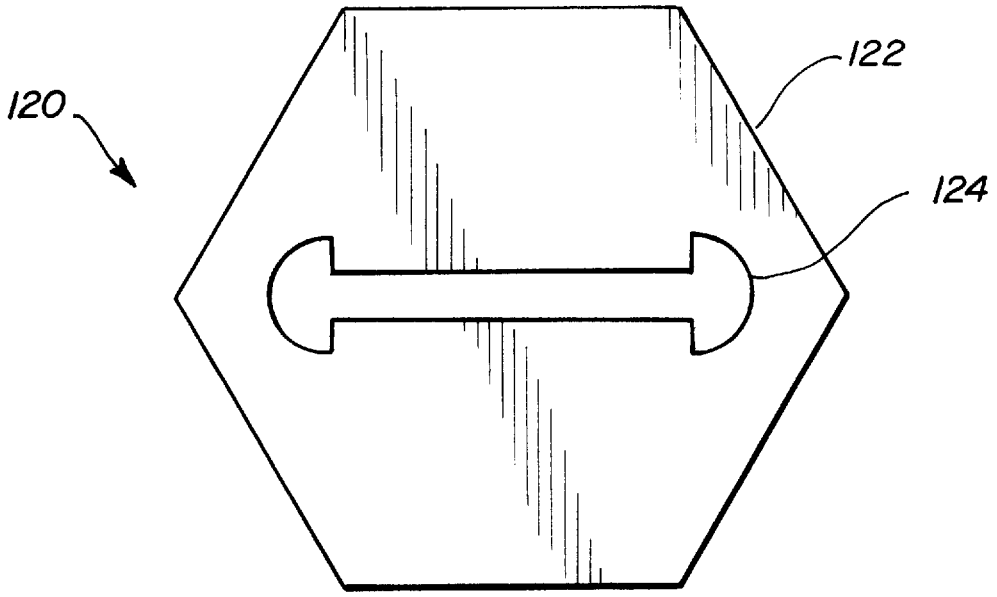
FIG. 2 is a top view of the sign stand base of FIG. 1

FIG. 2 is a top view of base 120 showing disc 122 and through aperture 124. In the preferred embodiment, disc 122 is hexagonal. In other embodiments, disc 122 may be round, octagonal, or of other shapes. Through aperture 124 is shaped as the top cross section of the upper portion of frame 101 to provide ease of assembly of base 120 to frame 121 and to provide rigidity to the assembled sign stand.

Figure 3:
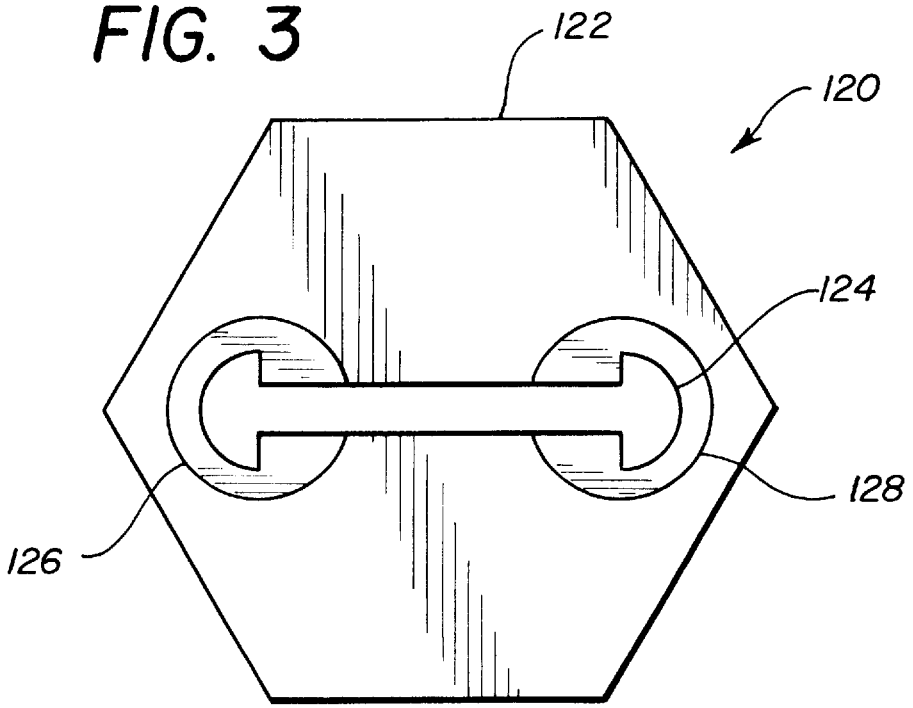
FIG. 3 is a bottom view of the sign stand base of FIG. 1.

FIG. 3 is a bottom view of base 120 showing through aperture 124, a first flange recess 126 and a second flange recess 128. First flange recess 126 provides a recess for receiving and retaining first flange 114 of FIG. 1 and second flange recess 128 provides a recess for receiving and retaining second flange 116. In the preferred embodiment, the fit between the flanges and recesses is an interference fit.

Figure 4:
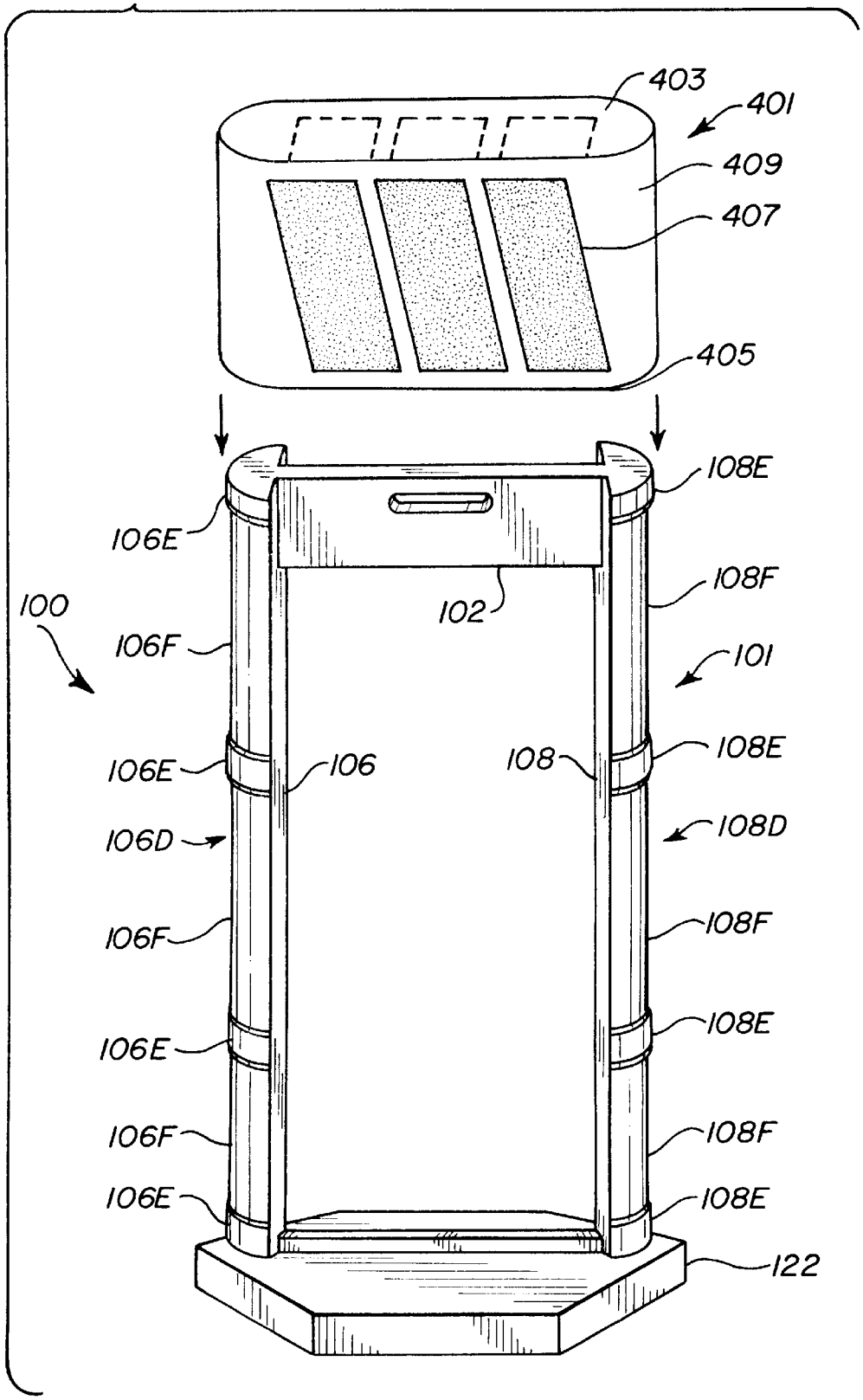
FIG. 4 is a perspective view of the sign stand and sleeve.

FIG. 4 is a perspective drawing of assembled sign stand 100 and a stretch sign sleeve 401 in position to be stretched over the stand. Sleeve 401 is made of a stretchable plastic film. In the preferred embodiment, sleeve 401 is made of polyethylene film. Sleeve 401 has an open top 403 and an open bottom 405. Indicia 407 is printed on the outside surface 409 of sleeve 401. Sleeve 401 is stretched over outside vertical surfaces 106D and 108D and relaxed so that the web is positioned in one of the recesses 106F and an opposite recess 108F. When released over recesses 106F and 108F, the web of sleeve 401 is still in a stretched condition. The amount of stretch of the web in this installed position is typically 1%–3%. Raised portions 106E and 108E engage sleeve 401 to prevent the sleeve from slipping out of the desired position.

As can be seen in the figure, indicia may also be printed on the opposite side of outside surface 409 from indicia 407. This allows the sign to convey information from either of two opposite directions. Indicia 407 may also be printed on the inside of the sleeve (not shown) if the film is transparent or translucent.

Figure 5:
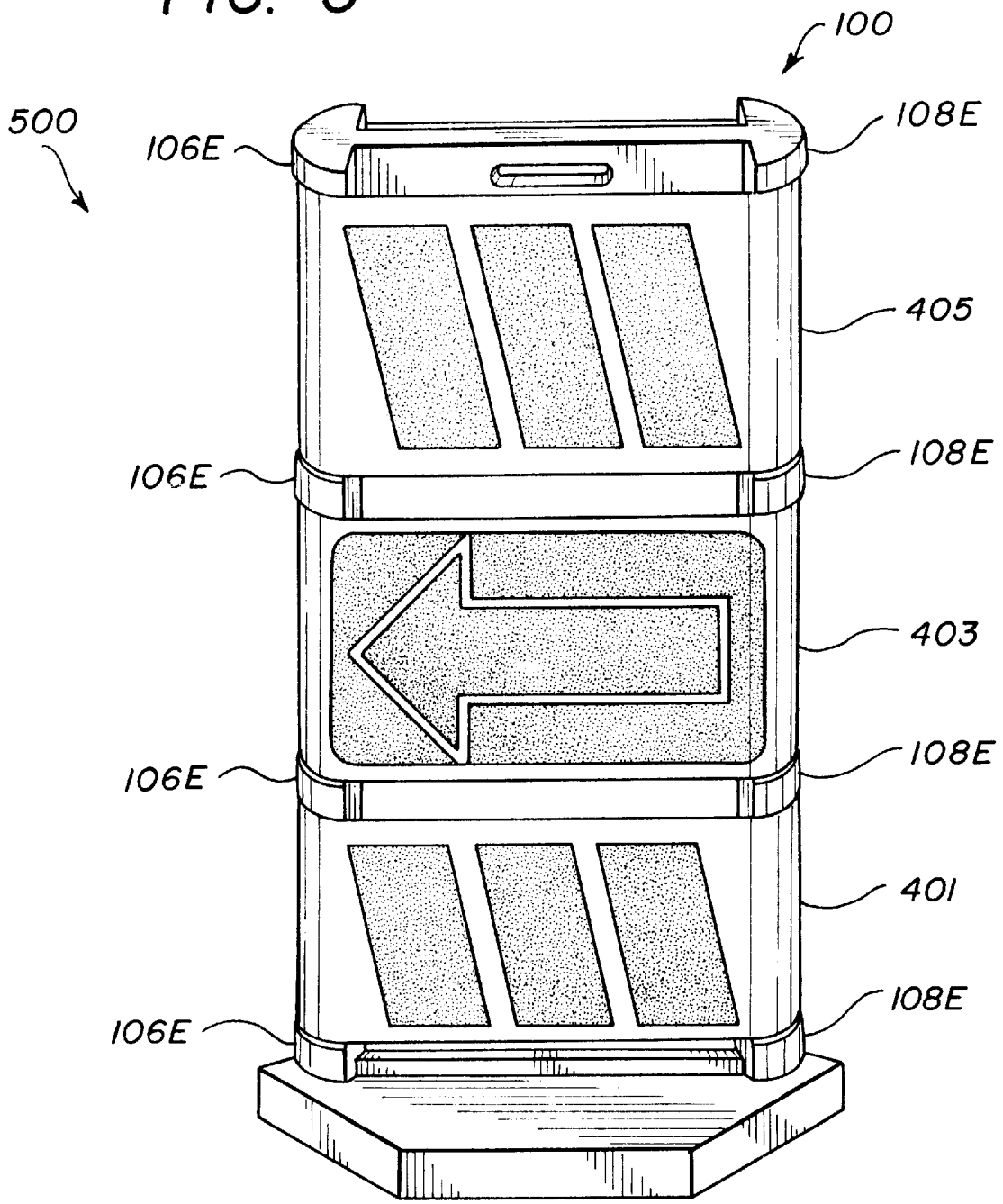
FIG. 5 is a perspective view of the assembled sleeve sign comprising a sign stand and three stretch sleeves.

FIG. 5 is a perspective drawing of assembled sleeve sign 500. Sleeves 401, 403, and 405 have been stretched and placed in recesses 106F of column 106 and recesses 108F of column 108 (see FIG. 4). Raised portions 106E and 108E engage sleeves 401, 403, and 405 to retain the sleeves in recesses 106F and 108F of sign stand 100.

Figure 6:
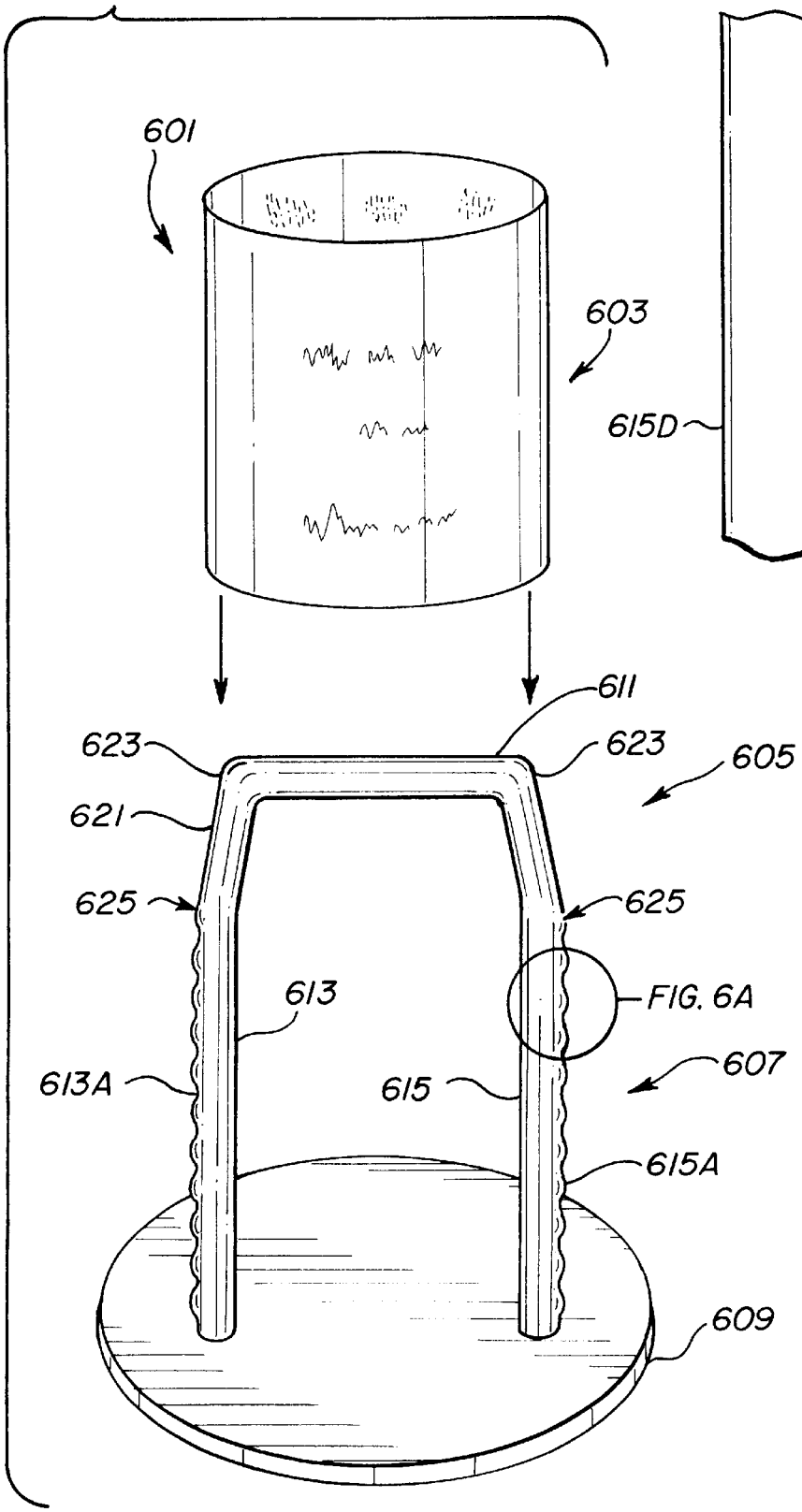
FIG. 6 is a perspective drawing of an alternative embodiment of the sign stand and sleeve of the present invention having a smooth raised portion on the vertical columns.

FIG. 6 is a perspective of embodiment 601 of sign sleeve 603 and sign stand 605. Sign stand 605 includes frame 607 and base 609. Frame 607 comprises top 611, first vertical column 613 and second vertical column 615. First outer vertical edge surface 613A of vertical column 613 and second outer vertical edge surface 615A of second vertical column 615 supports sleeve 603 when the sleeve is stretched over frame 607. As better shown in FIG. 6A, outer surface 615A of column 615 comprises a plurality of raised portions 615B and recessed portions 615C. Recessed portions 615C serve to receive and support sleeve 603 in the installed condition. Raised portions 615 serve to retain sleeve 603 on vertical surface 615A by requiring the sleeve to stretch further in order to move up or down on vertical surface 615A. The raised portions 615B form a smooth wave. Vertical surface 613A comprises similar raised portions and recessed portions. The plurality of raised portions and recessed portions of sign stand 605 allows different numbers and heights of sleeves 603 to be used with the same sign stand.

In order to securely retain sleeve 603 on vertical surfaces 613A and 615A, sleeve 603 must have a "lay flat" or relaxed circumference less than the measured circumference of the frame around outer vertical surfaces 613A and 615A. The difference in the lay flat circumference of sleeve 603 and the circumference around outside vertical surfaces 613A and 615A is the amount sleeve 603 must be stretched in order to fit over and be retained on stand 605. This amount of stretch should be a minimum of 0.25% for the recessed portions of the vertical surfaces. In the preferred embodiment, the amount of stretch is 1%–3% for the recessed portions. Additional stretch would be required at the raised portions. This additional stretch at the raised portions depends on the film used, thickness and expected environmental conditions and is typically 0.5%–5%. In some cases the additional stretch at the raised portions is 0.1% or less.

The plastic film used for the sleeve should have a minimum stretch of 0.5% with memory in order to be retained on the outside vertical surfaces. In other words, the film web of the sleeve may be stretched at least 0.5% of its lay flat or relaxed circumference and return to its lay flat circumference without appreciable yield. In the preferred embodiment, the film should have a stretch of at least 3% with memory in order to account for additional stretching of the sleeve over the frame to facilitate installation of the sleeve. A sufficient stretch with memory allows the reuse of the sleeve by allowing removal and re-installation of the sleeve without significant permanent stretch.

A tapered top portion 621 facilitates stretching of sleeve 603 over frame 607. Tapered portion 621 results in the circumference of the frame measured at top position 623 is less than the circumference measured at the sleeve retaining position 625.

Figure 6A:
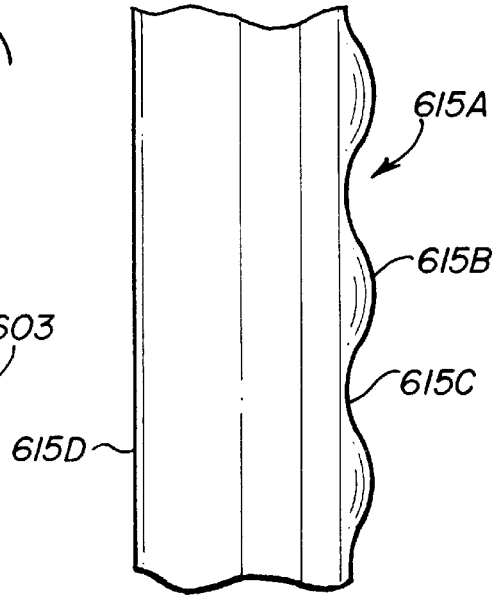
FIG. 6A is a detail perspective drawing of the smooth raised portion and recessed portion of the outside vertical surface of FIG. 6.

It is not necessary for the inside vertical surfaces 615D of FIG. 6A to comprise raised portions 615B and recessed portions 615C, but rather this may be done as a matter of preferred manufacturing methods.

Figure 7:
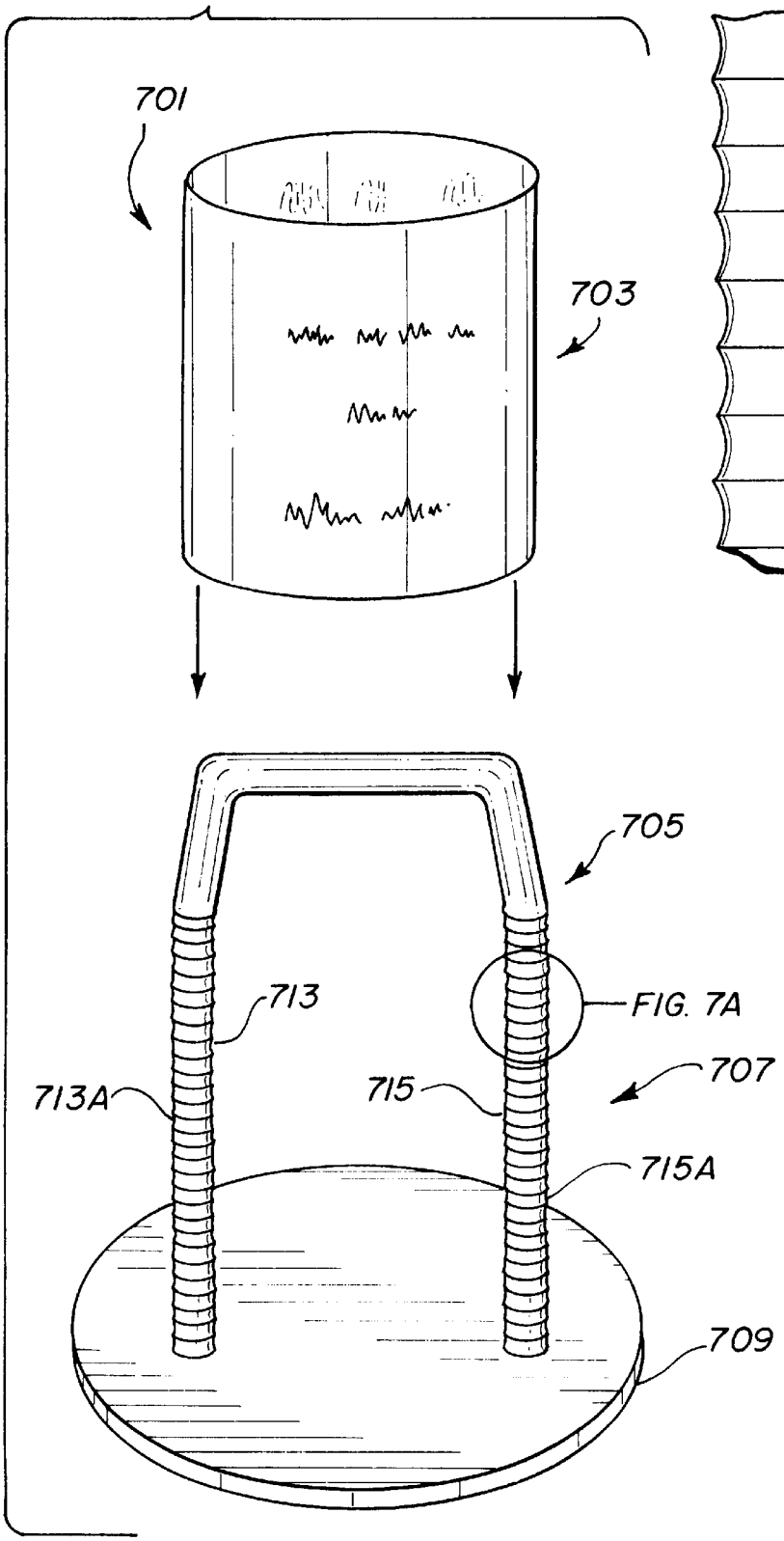
FIG. 7 is a perspective drawing of an alternative embodiment of the sign stand and sleeve of the present invention having a sharp edged raised portion on the vertical columns.
Figure 7A:
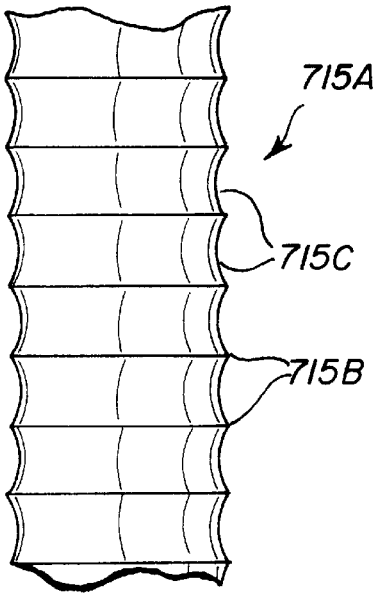
FIG. 7A is a detail perspective drawing of the sharp edged raised portion and recessed portion of the outside vertical surface of FIG. 7.

FIG. 7 is a perspective of embodiment 701 of sign sleeve 703 and sign stand 705. This embodiment differs from embodiment 601 in the shape of the raised portions 715B and recessed portions 715C of vertical surface 715A of FIG. 7A. Raised portions 715B form sharp edged waves or ridges to provide additional engagement and retaining of sleeve 703. Outside vertical surface 713A of first vertical column 713 is similar to outside vertical surface 715A of second vertical column 715. Base 709 provides stability. In an alternative embodiment, base 709 is omitted and vertical columns 713 and 715 are inserted into the ground. Making the bottom ends of columns 713 and 715 pointed or cone shaped facilitates insertion of the sign stand into the ground. The frame may also be clamped to other fixed surfaces instead of using a separate base.

Figure 8:
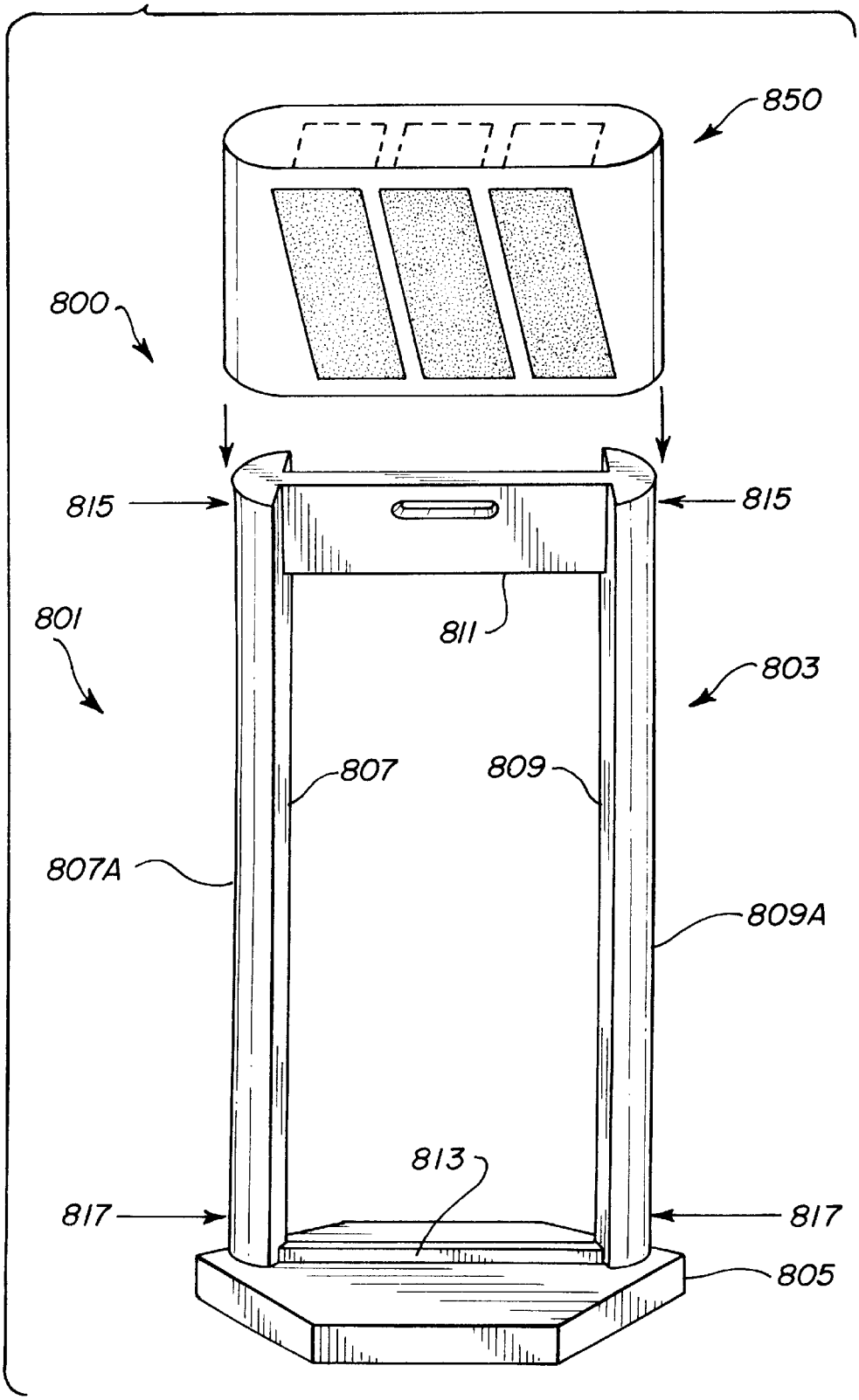
FIG. 8 is a perspective of an alternative embodiment of the sign stand having a taper between the vertical edge surfaces of the frame.

FIG. 8 is a perspective drawing of embodiment 800 of the sleeve sign. Sign stand 801 comprises frame 803 and base

805. Frame 803 consists of first vertical column 807, second vertical column 809, top beam 811 and bottom beam 813. First vertical column 807 comprises a first outside vertical surface 807A. Second vertical column 809 comprises a second outside vertical surface 809A. First outside vertical surface 807A and second outside vertical surface 809A form the receiving surfaces of frame 803 over which sign sleeve 850 is stretched.

First outside vertical surface 807A and second outside vertical surface 809A are tapered so that the separation distance between surface 807A and 809A at the top of the receiving surface, represented by distance 815 is less than the separation distance between surface 807A and 809A at the bottom of the receiving surface, represented by distance 817. In this regard, any upper portion of frame 803 serves as a recessed portion and a correspondingly lower portion of frame 803 serves as a raised portion to prevent the sleeve from sliding downward against gravity.

In the preferred embodiment, sign sleeve 850 is sized so that the circumference of the sleeve in the lay flat condition is 1%–3% less than the circumference of the frame at the midpoint of the final sleeve location. The taper is chosen so that adequate stretch, (at least 0.25%) exists at the top of the sleeve without exceeding the maximum stretch without yield at the bottom of the sleeve. This amount of taper depends on the sleeve material used, thickness of the sleeve material, and environmental considerations, but is typically 1/16 inch–½ inch separation per foot.

In the preferred embodiment, the sleeves are made of low density polyethylene (LDPE) film, 0.002–0.003 inches thick. Other plastic films 0.001–0.005 inches thick may be used as long as they exhibit sufficient stretch and memory.

Sleeves may be made by printing roll fed plastic film webs, folding along a longitudinal axis and heat sealing the edges, or tubular webs may be used. Indicia may be printed with solvent based or UV curable inks. The web may be laminated to prevent smearing of the inks and provide scuff and scratch resistance to the printing. Alternatively, a UV curable coating can be applied to a solvent based ink as disclosed in related application Ser. No. 08/702283. UV blocking agents may be added to the coatings, laminations, or substrate to reduce fading of the indicia.

The sign stand may be made of plastic, metal, composites, or wood. The frame should be light in weight and the base made of a dense material to improve stability. The sign frame may be of a light rigid material such as plastic or aluminum pipe or tubing. In the preferred embodiment, the frame is made of rigid plastic foam. The base may be solid plastic, metal, or composites. In the preferred embodiment, the base is made of cast rubber from recycled tires.

Accordingly the reader will see that the Sleeve Sign And Stand provides a highly visible sign in which the indicia carrying web and can be easily changed. The device provides the following additional advantages:

The sleeve sign can be seen from opposite directions;

The sleeves are low in cost and can be reused or recycled; and

The sign frame is simple, low in cost, and easily assembled.

Although the description above contains many specifications, these should not be construed as limiting the scope of the invention but as merely providing illustrations of some of the presently preferred embodiments of this invention. For example, the top and bottom beams may be eliminated and the vertical edges cantilevered from the base. The receiving surfaces may be horizontal members attached to a post or frame, etc. Thus the scope of the invention should be determined by the appended claims and their legal equivalents, rather than by the examples given.

I Claim:

1. A sleeve display sign for displaying indicia, the sign comprising:

a sign stand, the stand comprising a generally rectangular frame, the frame comprising a top, a bottom, and at least two receiving surfaces, each of said at least two receiving surfaces of the frame comprising a plurality of raised portions and a plurality recessed portions, said plurality of raised portions and said plurality of recessed portions fixed with respect to the frame, and a base, the base supporting the frame so that said at least two receiving surfaces are substantially vertical; and a stretch sleeve retained on said at least two receiving surfaces, the sleeve comprising an open top and an open bottom, the sleeve made from a stretchable plastic film with memory with indicia printed on at least one surface of the film;

whereby said plurality of raised portions of said each of said at least two receiving surfaces of said frame engage the sleeve to retain the sleeve on the frame when the sleeve is stretched over the frame and relaxed.

2. The sleeve sign of claim 1 wherein the plastic film is low density polyethylene film having a stretch of at least 0.5% with memory.

3. The sign stand of claim 1 wherein said plurality of raised portions and said plurality of recessed portions comprise a plurality of steps along said each of said at least two receiving surfaces.

4. The sign stand of claim 1 wherein said at least two receiving surfaces comprising a first vertical column comprising a first vertical edge surface and a second vertical column comprising a second vertical edge surface, said first vertical edge surface comprising said plurality of raised portions said plurality of recessed portions and said second vertical edge surface comprising said plurality of raised portions and said plurality of recessed portions, said first vertical column attached to said second vertical column by a top beam and a bottom beam.

5. The sign stand of claim 4 wherein the frame is made of a plastic material.

6. The sign stand of claim 5 wherein the frame is made of a light weight rigid foam plastic material.

7. A sleeve display sign for displaying indicia, the sign comprising:

a generally rectangular frame comprising a top, a bottom, and at least two receiving surfaces, said at least two receiving surfaces defining a taper whereby a first separation distance between said at least two receiving surfaces at a first position of said at least two receiving surfaces is less than a second separation distance between said at least two receiving surfaces at a second position of said at least two receiving surfaces;

a stretch sleeve disposed on said at least two receiving surfaces, the sleeve comprising an open top and an open bottom, the sleeve made from a stretchable plastic film with memory with indicia printed on at least one surface of the film;

said taper of said at least two receiving surfaces engaging said stretch sleeve to retain said stretch sleeve in a desired position on said at least two receiving surfaces when said stretch sleeve is stretched over said frame and relaxed on said at least two receiving surfaces; and a base attached to the bottom of the frame, the base supporting said at least two receiving surfaces in a substantially vertical position.

* * * * *